US010994429B2

(12) United States Patent
Wang

(10) Patent No.: US 10,994,429 B2
(45) Date of Patent: May 4, 2021

(54) RETRACTABLE CUTTING TOOL

(71) Applicants: HANGZHOU GREAT STAR INDUSTRIAL CO., LTD., Hangzhou (CN); HANGZHOU GREAT STAR TOOLS CO., LTD., Hangzhou (CN)

(72) Inventor: Weiyi Wang, Hangzhou (CN)

(73) Assignees: HANGZHOU GREAT STAR INDUSTRIAL CO., LTD., Hangzhou (CN); HANGZHOU GREAT STAR TOOLS CO., LTD., Hangzhou (CN)

( * ) Notice: Subject to any disclaimer, the term of this patent is extended or adjusted under 35 U.S.C. 154(b) by 163 days.

(21) Appl. No.: 15/729,072

(22) Filed: Oct. 10, 2017

(65) Prior Publication Data

US 2019/0022878 A1 Jan. 24, 2019

Related U.S. Application Data

(63) Continuation-in-part of application No. PCT/CN2017/093560, filed on Jul. 19, 2017.

(51) Int. Cl.
*B26B 1/08* (2006.01)
*B26B 5/00* (2006.01)

(52) U.S. Cl.
CPC ..... *B26B 5/003* (2013.01); *B26B 1/08* (2013.01); *B26B 5/001* (2013.01)

(58) Field of Classification Search
CPC ..... B26B 1/08; B26B 5/001; B26B 5/003; B26B 5/002; B26B 5/005–007
USPC ..... 30/162, 335, 336
See application file for complete search history.

(56) References Cited

U.S. PATENT DOCUMENTS 5,303,474 A * 4/1994 Keklak et al. ..... B26B 5/003 30/125
5,890,294 A * 4/1999 Keklak ..... B26B 5/001 30/125
8,220,161 B2 7/2012 Chang
9,174,347 B2 11/2015 Hongquan et al.
2004/0237312 A1* 12/2004 Hernandez ..... B26B 5/001 30/162
2008/0250651 A1* 10/2008 Davis ..... B26B 5/001 30/162

(Continued)

FOREIGN PATENT DOCUMENTS

CN 101659061 A 3/2010
CN 102825614 A 12/2012

(Continued)

*Primary Examiner* — Clark F Dexter
(74) *Attorney, Agent, or Firm* — Fitch, Even, Tabin & Flannery LLP

(57) ABSTRACT

The present invention provides a retractable cutting tool, which includes: a cutting tool housing, the interior thereof forming a cavity; a blade exit portal, penetrating through the cutting tool housing and communicating with the cavity; a blade holder, moved or locked in the cutting tool housing; a blade, mounted to the blade holder and disposed opposite the blade exit portal; when the blade holder is moved, the front end of the blade protrudes out of the cutting tool housing or retracts into the cutting tool housing through the blade exit portal; a blade holder moving device, for moving the blade holder in the cutting tool housing; and a protrusion length control device, for controlling the protrusion length of the blade outside the cutting tool housing.

20 Claims, 11 Drawing Sheets

(56) References Cited

U.S. PATENT DOCUMENTS

| | | | | |
|---|---|---|---|---|
| 2010/0037465 | A1 | 2/2010 | Price | |
| 2010/0088900 | A1* | 4/2010 | Davis | B26B 5/003 30/162 |
| 2010/0319200 | A1* | 12/2010 | Davis | B26B 5/003 30/162 |
| 2015/0013171 | A1 | 1/2015 | Wu | |
| 2015/0174772 | A1 | 6/2015 | Kanemoto et al. | |
| 2016/0158945 | A1* | 6/2016 | Herlitz | B26B 5/003 30/162 |
| 2016/0279811 | A1* | 9/2016 | Huang | B26B 1/08 |
| 2018/0311839 | A1* | 11/2018 | Huang | B26B 5/003 |

FOREIGN PATENT DOCUMENTS

| | | | | | |
|---|---|---|---|---|---|
| CN | 204976674 | U | | 1/2016 | |
| CN | 206105908 | U | | 4/2017 | |
| DE | 20 2013 007 112 | U1 | * | 12/2014 | B26B 5/001 |
| EP | 1 946 897 | A1 | * | 7/2008 | B26B 5/003 |
| EP | 2 979 828 | A1 | * | 2/2016 | B26B 5/001 |
| WO | WO 98/32572 | | * | 7/1998 | B26B 5/001 |

* cited by examiner

RETRACTABLE CUTTING TOOL

CROSS-REFERENCE TO RELATED APPLICATION

This application is a continuation-in-part of International Application No. PCT/CN2017/093560, filed on Jul. 19, 2017, and all contents of this International application are incorporated herein by reference.

FIELD OF THE INVENTION

The present invention relates to a hand tool, and in particular, to a retractable cutting tool.

DESCRIPTION OF THE PRIOR ART

A common hand-held cutting tool mainly pertains to a folded-type and a blade sheath-type. In use, a blade length exposed outside a hand-held portion is usually unchanged, which can effectively ensure safety in use. In most cases, the blade length of the hand-held cutting tool is not needed to be adjusted constantly by the user, so the folded-type or the blade sheath-type cutting tools can meet the needs of most users.

However, in some specific applications, for example, when the user needs to cut a product packaging without damaging the inner product or the inner packing, the user is required to strictly control the infeed strength, making the operation inconvenient and posing certain safety risks.

In the prior art, a box cutter (or referred to as a stationery cutter) has a blade length that is freely retractable and extensible, but the disadvantage of which lies in a weak lock-up structure of the box cutter, poor stability and locking effects, proneness to be damaged and a short service life. The blade may slide even in a locked state, thereby increasing the safety risks in use. In addition, during the extension and retraction of the blade, three steps of unlocking, moving and locking the blade need to be performed by the user, rendering the operation complicated. Moreover, the blade is neither retractable in use, nor automatically withdrawable after use. Once the user haphazardly places the cutting tool after use, the blade is kept to be in an exposed state, posing serious security risks.

Persons skilled in the art are endeavoring to develop a novel retractable cutting tool that enables the blade to be freely retractable during use, facilitating the user to adjust the blade length as desired, such that the blade can be automatically withdrawn back to the hand-held portion after use, thus improving the safety performance of the cutting tool.

SUMMARY OF THE INVENTION

An object of the present invention is to provide a retractable cutting tool to solve the technical problems existing in the retractable cutting tool of the prior art: poor structural stability, complicated operation and the blade is impossible to be automatically withdrawable.

In order to solve the above technical problems, the present invention provides a retractable cutting tool, including a cutting tool housing, the interior thereof forming a cavity; a blade exit portal, penetrating through a front end of the cutting tool housing and communicating with the cavity; a blade holder, which is moved or locked in the cutting tool housing; a blade, which is assembled to the blade holder and disposed opposite the blade exit portal; when the blade holder is moved, the front end of the blade protrudes out of the cutting tool housing or retracts into the cutting tool housing through the blade exit portal; a blade holder moving device, for moving the blade holder in the cutting tool housing; and an protrusion length control device, for controlling the protrusion length of the blade outside the cutting tool housing.

Further, in different embodiments, the cutting tool housing includes a first housing, provided with a first housing latch slot; a second housing, provided with a second housing latch slot, the second housing disposed opposite the first housing; and a cap, detachably connected to the first housing and/or the second housing; the cap includes a first cap plate, which is provided with a protruding first snap latch at the bottom, snap-fitted to the first housing latch slot; and a second cap plate, which is disposed opposite the first cap plate, and is provided with a protruding second snap latch at the bottom, snap-fitted to the second housing latch slot.

Further, in different embodiments, the blade holder moving device includes two parallel rectilinear guide rails, protruding from one side surface of the blade holder; a guide rail gap, formed between the two guide rails; and a housing sliding block, protruding from an inner sidewall of the cutting tool housing towards the blade holder, and snapped in the guide rail gap; when the blade holder is moved, the housing sliding block slides with respect to the two guide rails.

Further, in different embodiments, the blade holder moving device includes a driving member, one end of which is hinged to the cutting tool housing, the other end of which includes a first driving plate provided with a first driving plate through hole; a second driving plate, disposed opposite the first driving plate; the second driving plate is provided with a second driving plate through hole, disposed opposite the first driving plate through hole; a driving shaft pin, one end of which is slidably mounted into the first driving plate through hole, and the other end of which is slidably mounted into the second driving plate through hole; and a driving base plate, for connecting the first driving plate and the second driving plate.

Further, in different embodiments, the blade holder moving device includes a first lever, one end of which is hinged to the cutting tool housing, and the other end of which is rotatably mounted to the driving shaft pin; a second lever, one end of which is hinged to the blade holder, and the other end of which is rotatably mounted to the driving shaft pin; and an elastic member, one end of which is connected to the cutting tool housing, and the other end of which is connected to the blade holder.

Further, in different embodiments, when the driving base plate is stressed, the driving shaft pin is pushed by the first lever to slide in the first driving plate through hole and the second driving plate through hole; the blade holder is pushed by the second lever to move towards the blade exit portal, the elastic member is deformed; the length of the blade extending outside the cutting tool housing is directly proportional to a distance by which the blade holder moves towards the blade exit portal; when the driving base plate is unstressed, the elastic member resiles to push the blade holder to move away from the blade exit portal.

Further, in different embodiments, the protrusion length control device includes a locking sheet, sliding in a locking sheet slide groove of an inner sidewall of the first housing; a stop piece, protruding from the surface of the locking sheet towards the driving member side; and at least one stop position engaging opening, arranged at an edge of the first driving plate; when the driving base plate is stressed, the stop piece can be snap-fitted to any one of the stop position engaging openings.

Further, in different embodiments, when the blade holder is moved, the stop piece slides at the top of the first driving plate or in any one stop position engaging opening; the length of the blade extending outside the cutting tool housing is directly proportional to a distance by which the stop piece slides; when the blade holder is locked, the stop piece can be selectively snap-fitted to any one of the stop position engaging openings, or away from or tangent to the top of the first driving plate; the length of the blade extending outside the cutting tool housing corresponds to the position of the stop piece.

Further, in different embodiments, the stop piece includes the following that are integrally formed: a strip-shaped portion, having a parallelogram cross-section; a stop piece protruding portion, protruding from a bottom surface of the strip-shaped portion, two base angles of the cross-section thereof being rounded angles; and an arch portion, which has an arch cross-section, and the bottom surface thereof being connected to a side surface of the strip-shaped portion; wherein a stop piece slide groove is formed between the stop piece protruding portion and the locking sheet.

Further, in different embodiments, the stop position engaging opening includes an engaging opening sidewall, arranged at one side of the stop position engaging opening; an engaging opening protruding portion, protruding from the other side of the stop position engaging opening; an engaging opening lug, protruding from the bottom surface of the stop position engaging opening and provided between the engaging opening sidewall and the engaging opening protruding portion, which is rectilinear; and a engaging opening slide groove, formed at the bottom surface of the stop position engaging opening and located at one side or both sides of the engaging opening lug. Or, the stop position engaging opening includes an engaging opening sidewall, provided at one side of the stop position engaging opening; an arc recess, arranged at the other side of the stop position engaging opening, and corresponding to the arch portion.

Further, in different embodiments, the protrusion length control device further includes a stop position hole, penetrating through a sidewall of the first housing and disposed opposite the locking sheet; a stop position lever, protruding from a surface of the locking sheet towards the first housing, and sliding in the stop position hole; a lock button, arranged outside the first housing and connected to the stop position lever; and a stop position mark, provided at an outer surface of the first housing and corresponding to the stop position hole.

Further, in different embodiments, the retractable cutting tool further includes a blade latch slot, arranged at an upper portion of the blade holder, whose shape corresponds to that of the blade; a blade engaging opening, arranged at a ridge of the blade; and a blade locking block, protruding from an inner surface of the blade latch slot, and snap-fitted to the blade engaging opening.

Further, in different embodiments, the blade latch slot includes a first blade baffle, which is L-shaped and disposed opposite a middle portion and a rear end of the blade; a second blade baffle, which is L-shaped and disposed opposite a front end of the blade; wherein the first blade baffle and the second blade baffle are arranged at both sides of the blade respectively; the blade locking block protrudes from an inner side surface of the first blade baffle.

Further, in different embodiments, the retractable cutting tool further includes a blade changing device, for detaching the blade from the blade holder, or for mounting the blade to the blade holder.

Further, in different embodiments, the blade changing device includes: a blade changing button mounting hole, arranged at the front end of the first housing and penetrating through the first housing; an inner sidewall of the blade changing button mounting hole is provided with a button slide groove; a blade changing button, mounted into the blade changing button mounting hole; an outer sidewall of the blade changing button is provided with a protruding button sliding block that is snapped into the button slide groove; a blade changing gasket, fixed to an inner surface of the first housing and disposed opposite the front end of the blade; and a blade changing elastic member, one end of which is connected to the blade changing button, and the other end of which is connected to the blade changing gasket; when the blade changing button is pressed, the button sliding block slides in the button slide groove, and the blade changing gasket pushes the front end of the blade.

Further, in different embodiments, the blade changing button mounting hole is provided with a button slide groove at an inner sidewall; the blade changing button is provided with a protruding button sliding block at an outer sidewall, snapped into the button slide groove; when the blade changing button is pressed, the button sliding block slides in the button slide groove, and the blade changing gasket pushes the front end of the blade.

Further, in different embodiments, the retractable cutting tool further includes a blade magazine, fixed to the blade holder; and a spare blade, disposed in the blade magazine.

Further, in different embodiments, the blade magazine includes a first blade magazine sidewall; a second blade magazine sidewall, disposed opposite the first blade magazine sidewall; a blade magazine opening, arranged at the top of the blade magazine; a blade magazine spring sheet, arranged at an inner side of the first blade magazine sidewall and bending inwards the blade magazine; a sidewall notch, penetrating through the second blade magazine sidewall; and a cover plate of the blade magazine, mounted to the blade magazine opening, and connected to the cap.

Further, in different embodiments, the retractable cutting tool further includes a blade sheath, detachably connected to the cutting tool housing, and disposed opposite the blade exit portal.

Further, in different embodiments, the blade sheath includes a blade sheath body, which is provided with a blade sheath cavity therein; a blade sheath opening, arranged at the surface of the blade sheath body, the cutting tool housing moves in and out of the blade sheath cavity via the blade sheath opening; and a blade sheath clamping strip, protruding from the inner surface of the blade sheath body, for being snap-fitted to the outer surface of the cutting tool housing.

Further, in different embodiments, the retractable cutting tool further includes a blade sheath clamp, rotatably and/or detachably connected to the blade sheath.

Further, in different embodiments, the blade sheath clamp includes a first clamping plate; a second clamping plate, disposed opposite the first clamping plate; a clamping plate shaft pin, through which the first clamping plate is hinged to the second clamping plate; and a clamping plate torsional spring, provided around the outside of the clamping plate shaft pin and including two supporting ends for supporting the first clamping plate and the second clamping plate respectively; a clamp casing, arranged at the surface of the blade sheath clamp and forming a casing hollow cavity together with the surface of the blade sheath clamp; a casing opening, arranged at one end of the clamp casing; a casing through hole, penetrating through the clamp casing, being adjacent to and communicating with the casing opening; and three or more casing sliding teeth, protruding from and uniformly distributing around the inner sidewall of the casing through hole, a casing sliding tooth space being formed between any two adjacent casing sliding teeth.

Further, in different embodiments, the retractable cutting tool includes a blade sheath snap ring and an elastic snap collar and an elastic snap stopper mounted into the blade sheath snap ring. The blade sheath snap ring includes a snap ring body, protruding from the blade sheath surface; a snap ring base, arranged at the top of the snap ring body; a snap ring stop piece, protruding from the snap ring base; a sliding tooth opening, penetrating through a sidewall of the snap ring body; and a snap stopper mounting pillar, protruding from the surface of the blade sheath, and arranged in the center of the blade sheath snap ring. The elastic snap collar includes a snap collar sliding tooth, protruding from the outer sidewall of the elastic snap collar and passing through the sliding tooth opening to be snap-fitted to any one of the casing sliding tooth spaces; and a snap collar opening, arranged at the sidewall of the elastic snap collar which is disconnected at the snap collar opening. The elastic snap stopper includes a snap stopper base, arranged in the casing hollow cavity; and a snap stopper sleeve, protruding from the snap stopper base, provided around the outside of the snap stopper mounting pillar.

The present invention has the beneficial effects that the present invention provides a retractable cutting tool, the blade of which is retractable in use, which is convenient for the user to adjust the length of the blade protruding out of the cutting tool housing in a service condition as needed, with simple operation, convenient use and good user experience. In the present invention, the blade after use is automatically withdrawable to the hand-held portion, which improves the safety performance of the cutting tool, provides a stable structure, is not easy to be damaged, and is suitable for a mass production. In the present invention, the blade can also be replaced, which further prolongs the service life; the blade sheath and the clamp can also be additionally provided, which effectively avoids safety risks caused by unintended touch, and makes it convenient to carry.

DETAILED DESCRIPTION OF THE PREFERRED EMBODIMENTS

Figure 1:
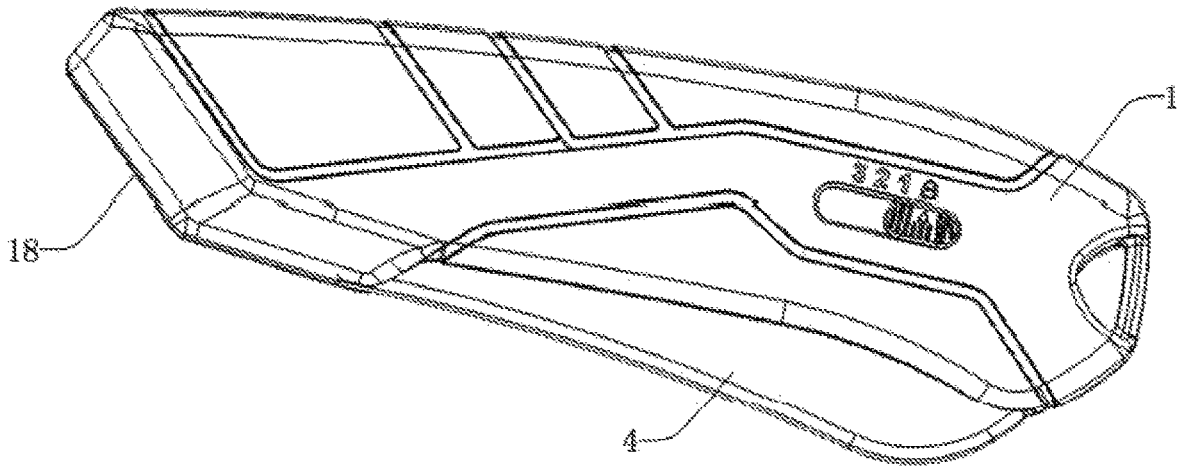
FIG. 1 is an overall structural schematic diagram of the first embodiment according to the present invention.

Preferred embodiments of the present invention will be described more fully hereinafter with reference to the accompanying drawings, in which preferred embodiments of the invention are shown, for the purpose of clarity and better understanding of the techniques. This invention may be embodied in various different forms and the invention should not be construed as being limited to the embodiments set forth herein.

In the description which follows elements with identical structure are marked with the same reference numerals, and like elements with similar structure or function are marked throughout with like reference numerals, respectively. The dimension and thickness of each element in the accompanying drawings are arbitrarily shown, and the invention does not define the dimension and thickness of each element. Certain elements may be shown somewhat exaggerated in thickness in the interest of clarity.

Directional terms described by the present invention, such as upper, lower, front, back, left, right, inner, outer, side, top, bottom, upper end, lower end, terminal end and etc., are only directions by referring to the accompanying drawings, and are thus used to describe and understand the present invention, but the present invention is not limited thereto.

It will be understood that when an element is referred to as being "on" another element, it can be directly on the other element, or there may be an intermediate element to which it is attached, and the intermediate element is attached to the other element. When an element is referred to as being "mounted to" or "connected to" another element, either one can be understood as being directly "mounted" or "connected", or via an intermediate element to be indirectly "mounted to" or "connected to" the other element.

First Embodiment

Figure 2:
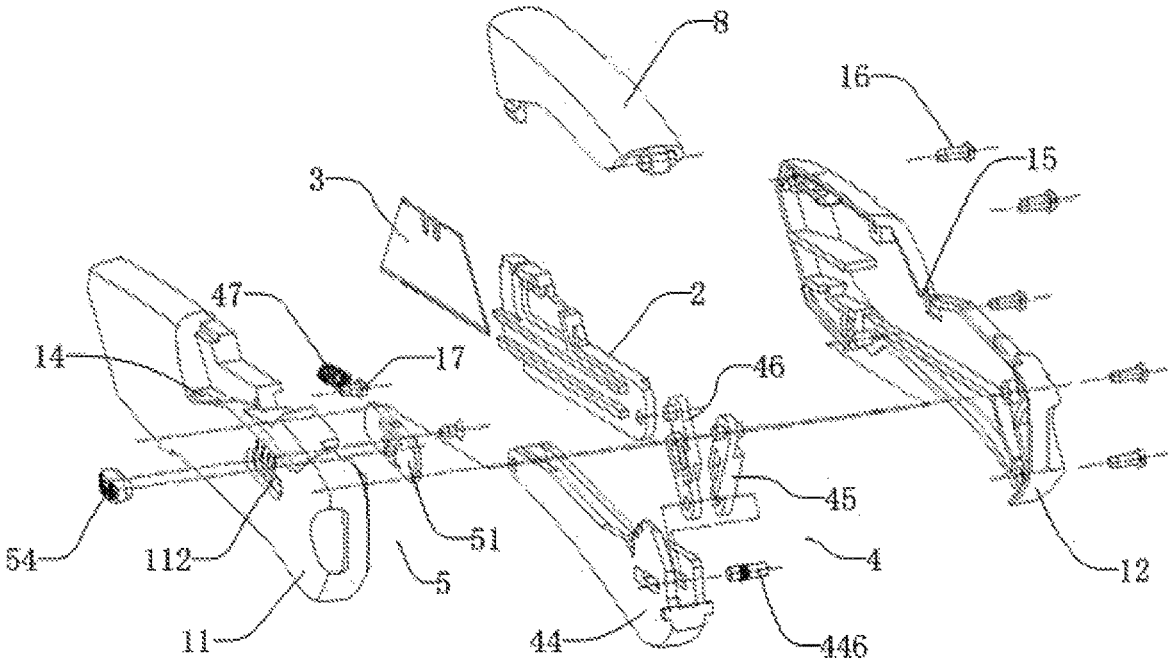
FIG. 2 is an exploded structural schematic diagram of the first embodiment according to the present invention.

As shown in FIGS. 1-2, the present embodiment provides a retractable cutting tool, including a cutting tool housing 1, a blade holder 2, a blade 3, a blade holder moving device 4 and a protrusion length control device 5.

Figure 3:
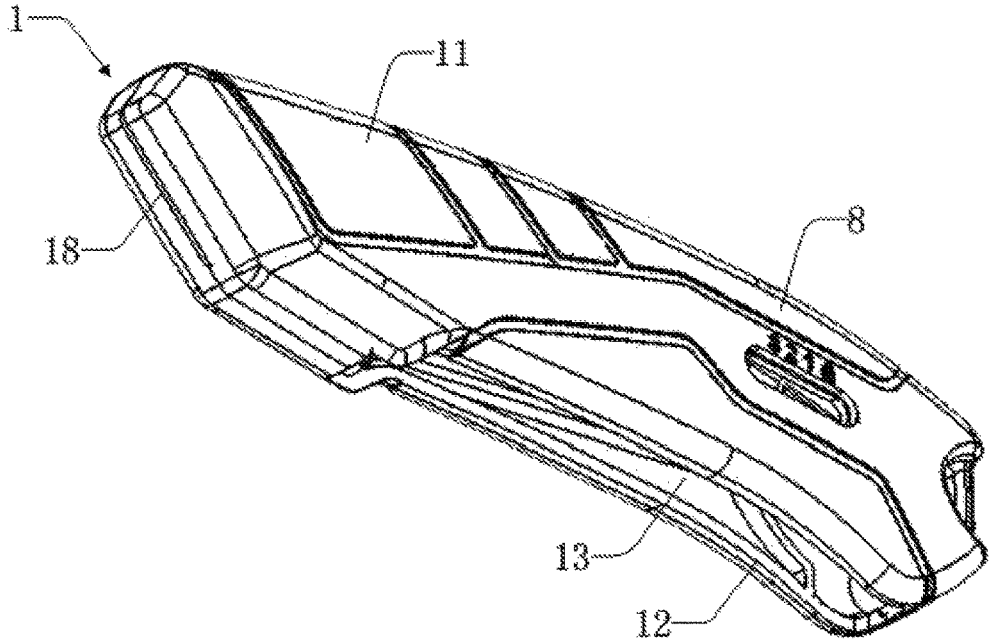
FIG. 3 is a structural schematic diagram of a cutting tool housing in the first embodiment according to the present invention.

As shown in FIGS. 2-3, the cutting tool housing 1 includes a first housing portion 11, hereinafter referred to as a first housing 11, and a second housing portion 12, hereinafter referred to as a second housing 12 disposed opposite the first housing 11, the first housing 11 and the second housing 12 being connected with each other by at least one fastener 16 (screw). The interior of the cutting tool housing 1 forming a cavity 13. Specifically, the first housing 11 and the second housing 12 are connected with each other to enclose the cavity 13.

Preferably, the present embodiment further includes a cap 8, mounted between the first housing 11 and the second housing 12 (a joint therebetween), and detachably connected to the first housing 11 and/or the second housing 12. The first housing 11 is provided with the first housing latch slot 14, and the second housing 12 is provided with the second housing latch slot 15.

Figure 4:
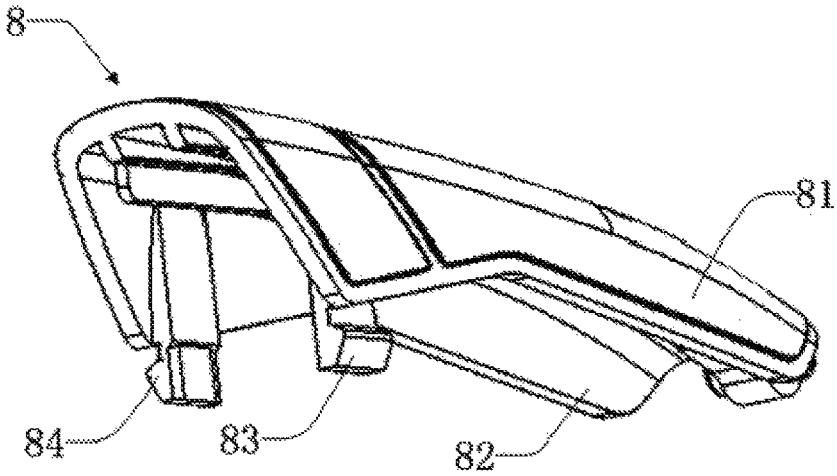
FIG. 4 is a structural schematic diagram of a cap in the first embodiment according to the present invention.

As shown in FIGS. 2 and 4, the cap 8 includes a first cap plate 81 and a second cap plate 82 disposed opposite the first cap plate 81; the first cap plate 81 is provided with a protruding first snap latch 83 at the bottom, which is snap-fitted to the first housing latch slot 14; the second cap plate 82 is provided with a protruding second snap latch 84, which is snap-fitted to the second housing latch slot 15.

The cap 8 is made of hard plastic, and is somewhat elastic. When the user 46 inwardly presses the first cap plate 81 and the second cap plate 82 from both sides of the cap 8 at the same time, the first cap plate 81 and the second cap plate 82 are deformed inwardly, such that the first snap latch 83 is released from the first housing latch slot 14, and the second snap latch 84 is released from the second housing latch slot 15, so that the cap 8 is separated from the first housing 11 and the second housing 12. In the case of installation, the user only needs to clamp the first snap latch 83 to the first housing latch slot 14 and the second snap latch 84 to the second housing latch slot 15.

As shown in FIGS. 1-3, the blade exit portal 18 penetrates through the front end of the cutting tool housing 1, and is communicating with the cavity 13. Preferably, the blade exit portal 18 is arranged at a joint between the first housing 11 and the second housing 12. In the present embodiment, the direction towards the blade exit portal 18 is referred to as front. Hereinafter, one end of each part close to the blade exit portal 18 is referred to as a front end, and one end thereof away from the blade exit portal 18 is referred to as a rear end.

Figure 6:
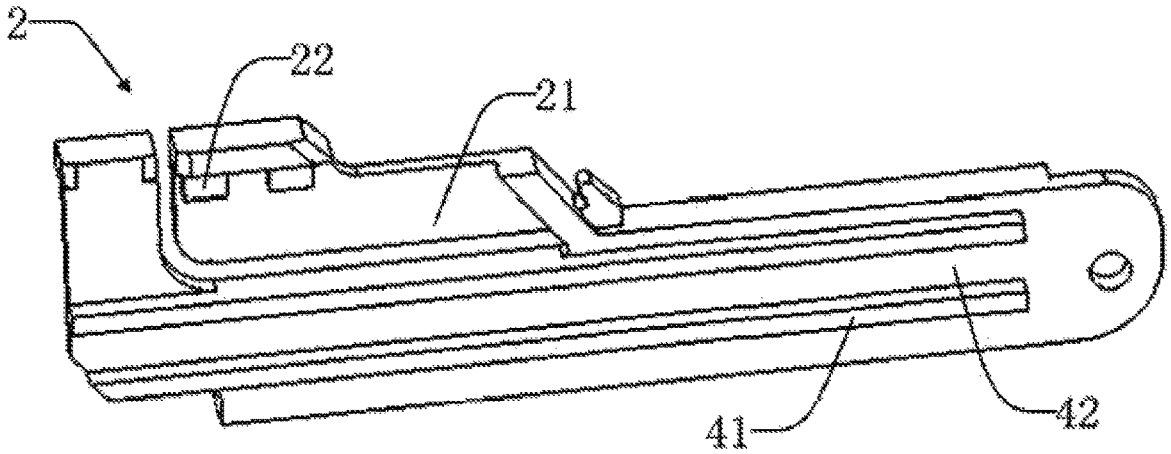
FIG. 6 is a structural schematic diagram of a blade holder in the first embodiment according to the present invention.
Figure 7:
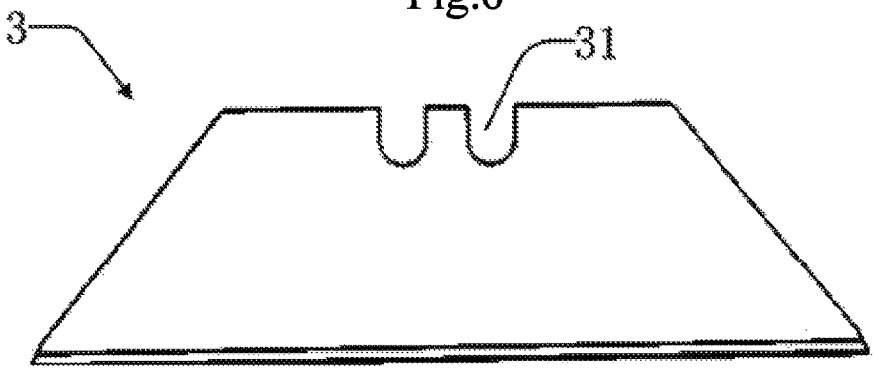
FIG. 7 is a structural schematic diagram of a blade in the first embodiment according to the present invention.
Figure 8:
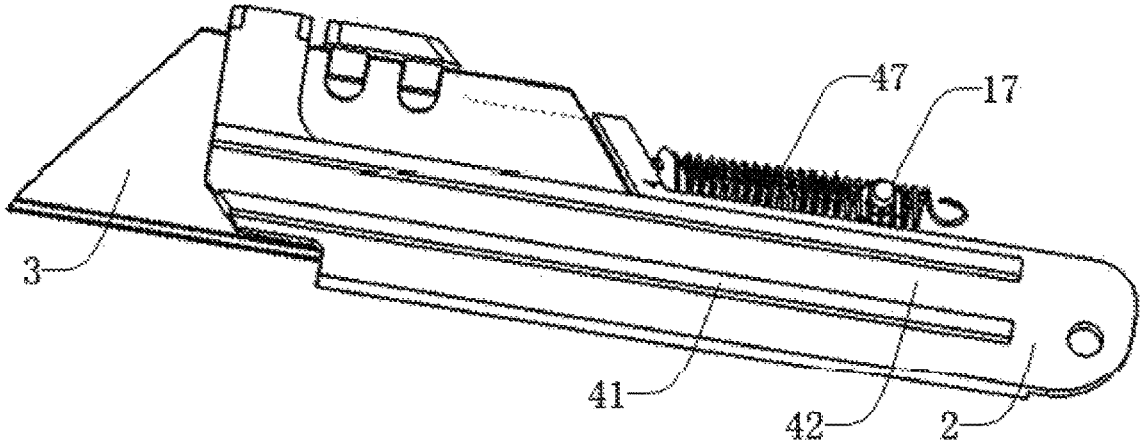
FIG. 8 is a structural schematic diagram subsequent to the assembly of the blade holder, the blade and the elastic member in the first embodiment according to the present invention.

As shown in FIGS. 6-8, the blade 3 is mounted to the front end of the blade holder 2, and is disposed opposite the blade exit portal 18. The blade holder 2 is provided with the blade latch slot 21, with a shape corresponding to the shape of the blade 3, for mounting the blade 3. The ridge of the blade 3 is provided with the blade engaging opening 31; the inner surface of the blade latch slot 21 is provided with a protruding blade locking block 22, snap-fitted to the blade engaging opening 31, such that the blade 3 is fixed to the blade holder 2.

When the blade holder 2 is moved, the front end of the blade 3 protrudes out of the cutting tool housing 1 or is retracted into the cavity 13 of the cutting tool housing 1 through the blade exit portal 18. The blade exit portal 18 is communicating with the cavity 13, such that the blade 3 in the cavity 13 can pass through the blade exit portal 18 to move in and out of the cutting tool housing 1.

Figure 9:
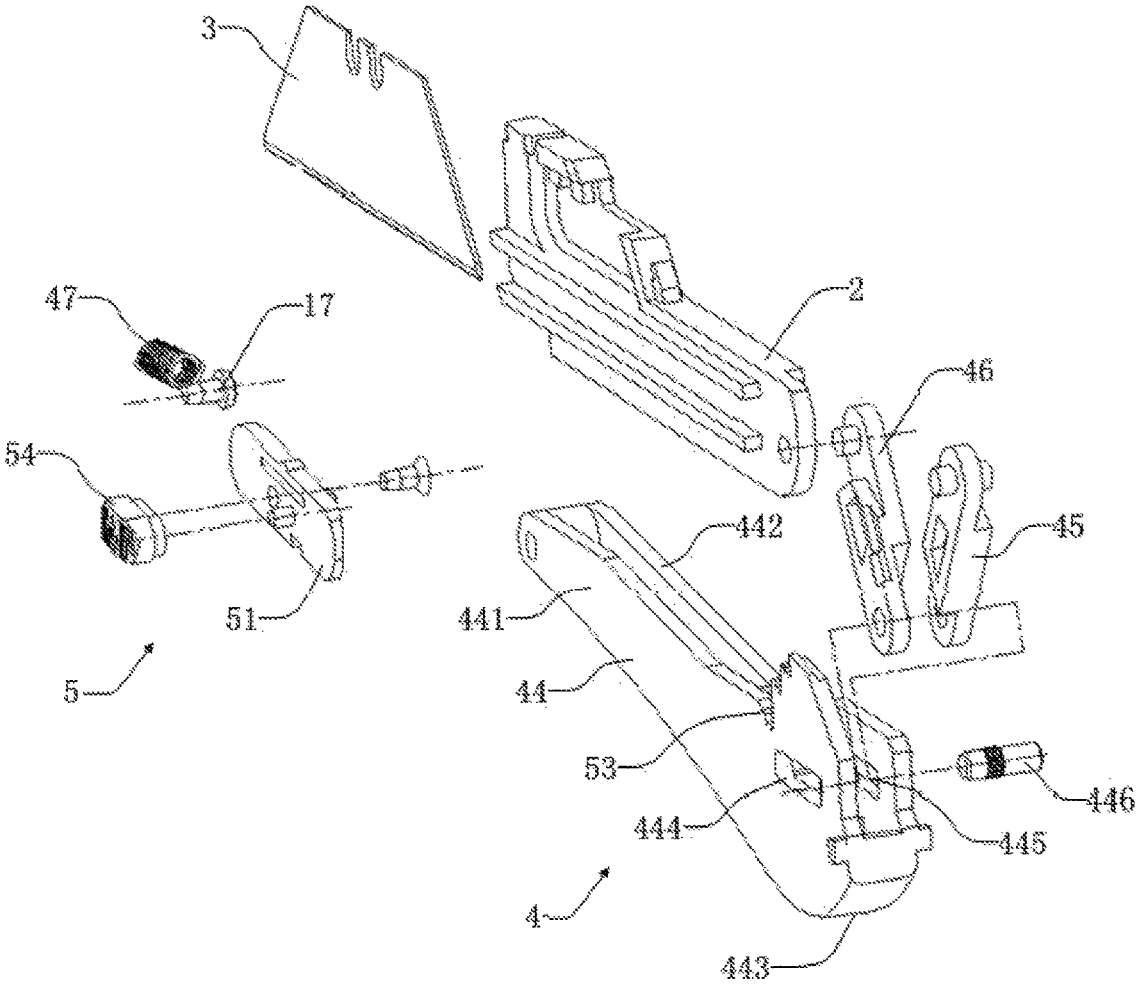
FIG. 9 is an exploded structural schematic diagram of a protrusion length control device in the first embodiment according to the present invention.

As shown in FIGS. 5-8, the blade holder moving device 4 is used for moving the blade holder 2 in the cutting tool housing 1 (in the cavity 13). The blade holder moving device 4 includes two rectilinear guide rails 41, a guide rail gap 42, and a housing sliding block 43. The two rectilinear guide rails 41 are parallel with each other, and protrude from one side surface of the blade holder 2; the guide rail gap 42 is formed between the two guide rails; the housing sliding block 43 protrudes from the inner sidewall of the cutting tool housing 1 towards the blade holder 2, and is slidably snapped into the guide rail gap 42; when the blade holder 2 is moved, the housing sliding block 43 slides with respect to the two guide rails 41. As shown in FIG. 9, the blade holder moving device 4 further includes a driving member 44 which is partially exposed outside the cutting tool housing 1, and is provided below the first housing 11 and the second housing 12. The driving member 44 includes a first driving plate 441, a second driving plate 442 and a driving base plate 443 which are integrated. The first driving plate 441 is parallel with and disposed opposite the second driving plate 442. The driving base plate 443 is used for connecting the first driving plate 441 and the second driving plate 442.

The front end of the driving member 44 is hinged to the cutting tool housing 1 via one shaft pin, one end of which is rotatably connected to the first housing 11, and the other end of which is rotatably connected to the second housing 12. When the driving member 44 is stressed by an upward force at the bottom, the front end of the driving member 44 is rotatable around the shaft pin by a small angle upwards.

The rear end of the driving member 44 is provided with a through hole 444 of the first driving plate, a through hole 445 of the second driving plate and a driving shaft pin 446. The through hole 444 of the first driving plate penetrates through the first driving plate 441, the through hole 445 of the second driving plate penetrates through the second driving plate 442, the through hole 444 of the first driving plate is disposed opposite the through hole 445 of the second driving plate, and the through hole 444 of the first driving plate and the through hole 445 of the second driving plate are rectilinear. One end of the driving shaft pin 446 is slidable in the through hole 444 of the first driving plate, and the other end thereof is slidable in the through hole 445 of the second driving plate. Therefore, the driving shaft pin 446 is slidable in the driving member 44 linearly.

The blade holder moving device 4 further includes a first lever 45 and a second lever 46, the first lever 45 hinged to the second lever 46 through the driving shaft pin 446. One end of the first lever 45 is hinged to the cutting tool housing 1, and the other end thereof is rotatably mounted to the driving shaft pin 446. One end of the second lever 46 is hinged to the blade holder 2, and the other end thereof is rotatably mounted to the driving shaft pin 446.

The blade holder moving device 4 further includes an elastic member 47, one end of which is connected to the cutting tool housing 1, and the other end of which is connected to the blade holder 2. In the present embodiment, the elastic member 47 is preferably a spiral spring, one end of which is fixed to the first housing 11 by one fastener 17 (preferably, a screw), and the other end of which is fixed to the blade holder 2.

When the driving base plate 443 is stressed, the driving shaft pin 446 is pushed by the first lever 45, and slides in the through hole 444 of the first driving plate 441 and the through hole 445 of the second driving plate 442. The blade holder 2 is pushed by the second lever 46 to move towards the blade exit portal 18, and the elastic member 47 (spiral spring) is compressed and deformed elastically. Specifically, when the driving base plate 443 is stressed by an upward force at the bottom, the rear end of the driving member 44 moves upwards due to the force. One end of the first lever 45 is hinged to the cutting tool housing 1, and the driving shaft pin 446 at the other end thereof is pushed by the first lever 45 to slide linearly in the driving member 44 forwards. The second lever 46 is pushed by the driving shaft pin 446 to slide forwards, the blade holder 2 is pushed by the second lever 46 to slide forwards, and the blade 3 at the front end of the blade holder 2 passes through the blade exit portal 18 to extend outside the cutting tool housing 1. The length of the blade 3 extending outside the cutting tool housing 1 is directly proportional to a distance the blade holder 2 moves towards the blade exit portal 18.

When the driving base plate 443 is unstressed, the elastic member 47 (spiral spring) resiles, to push the blade holder 2 to move away from the blade exit portal 18, and the blade 3 is retracted into the cavity 13 from the blade exit portal 18.

The protrusion length control device 5 is used for controlling the length of the blade 3 extending outside the cutting tool housing 1.

As shown in FIGS. 5, 9-14, the protrusion length control device 5 includes a locking sheet 51, a stop piece 52 and at least one stop position engaging opening 53. The inner sidewall of the first housing 11 is provided with a slide groove 111 for the locking sheet, in which the locking sheet 51 slides. The stop piece 52 protrudes from the surface of the locking sheet 51 towards the driving member 44 side. The stop position engaging opening 53 is arranged at an edge of the first driving plate 441; when the driving base plate 443 is stressed, the stop piece 52 is snap-fitted to any one stop position engaging opening 53.

When the blade holder 2 is moved, the stop piece 52 slides at the top of the first driving plate 441 or in any one stop position engaging opening 53; the length of the blade 3 extending outside the cutting tool housing 1 is directly proportional to a distance by which the stop piece 52 slides. When the blade holder 2 is locked, the stop piece 52 is selectively snap-fitted to any one stop position engaging opening 53, or away from or tangent to the top of the first driving plate 441; the length of the blade 3 extending outside the cutting tool housing 1 corresponds to the position of the stop piece 52.

Figure 10:
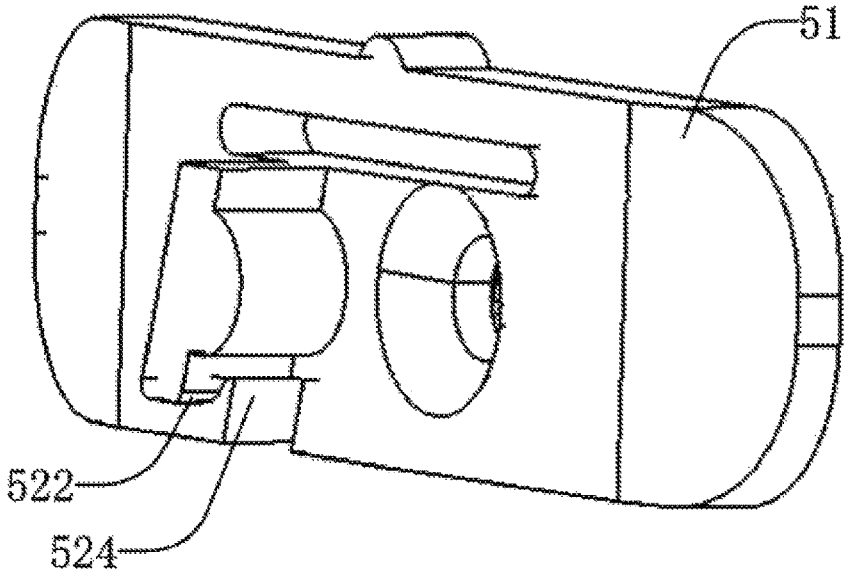
FIG. 10 is a structural schematic diagram of a rear surface of a locking sheet in the first embodiment according to the present invention.
Figure 11:
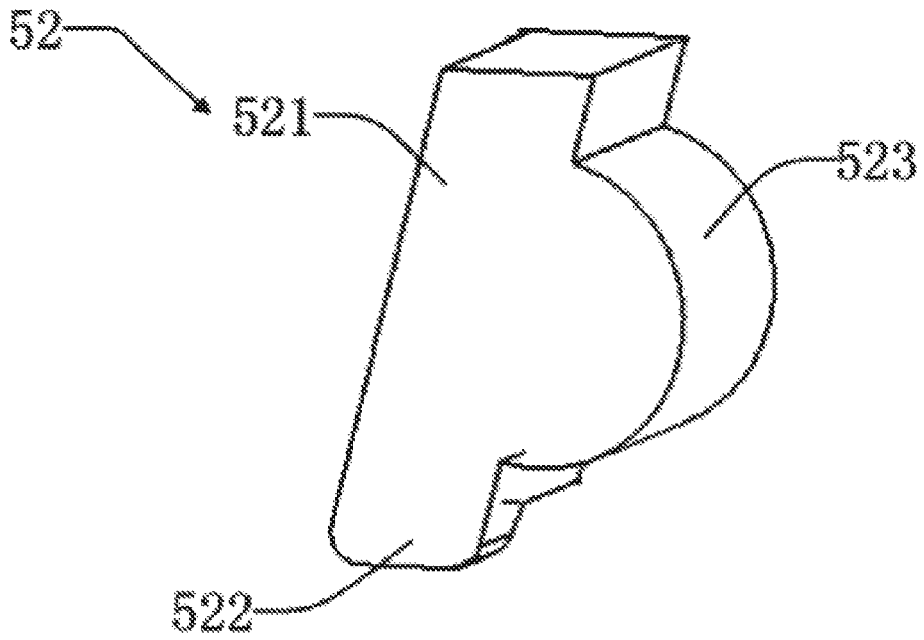
FIG. 11 is a structural schematic diagram of a stop piece in the first embodiment according to the present invention.

As shown in FIGS. 10-11, the stop piece 52 includes a strip-shaped portion 521, a stop piece protruding portion 522 and an arch portion 523 which are integrated. The strip-shaped portion 521 has a parallelogram longitudinal cross-section; the stop piece protruding portion 522 protrudes from a bottom of the strip-shaped portion 521, two base angles of its longitudinal cross-section being rounded angles; and the arch portion 523 has an arch cross-section, and is connected to a side of the strip-shaped portion 521; a slide groove 524 of the stop piece 52 is formed in the locking sheet 51.

Figure 12:
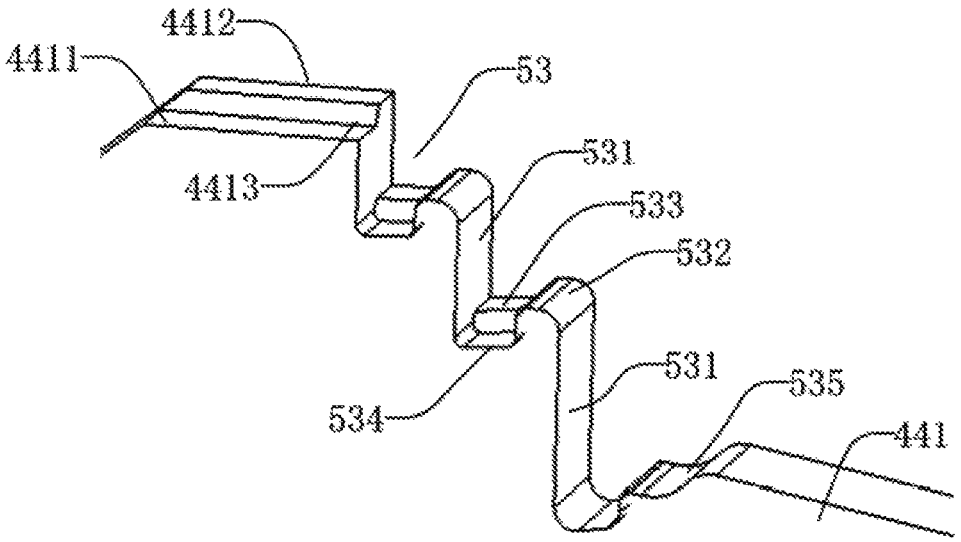
FIG. 12 is a structural schematic diagram of the top of a first driving plate and a stop position engaging opening in the first embodiment according to the present invention.

As shown in FIG. 12, the first driving plate 441 is provided with a top plane 4411 and a top lug 4412 at the top, the top lug 4412 protruding from the top plane 4411, which is rectilinear; the top plane 4411 forming a top slide groove 4413, located at one side or both sides of the top lug 4412, preferably one side in the present embodiment.

In the present invention, a plurality of stop positions is provided, preferably three stop positions in the present embodiment, from the rear end to the front end of the driving member 44, corresponding to the first stop position engaging opening, the second stop position engaging opening and the third stop position engaging opening successively. The stop position engaging openings 53 at the first two stop positions have the same structure, and the structure of the stop position engaging opening 53 at the last stop position is slightly different from the formers.

At the first two stop positions, the stop position engaging openings 53 (the first stop position engaging opening and the second stop position engaging opening) include an engaging opening sidewall 531, an engaging opening protruding portion 532, an engaging opening lug 533 and an engaging opening slide groove 534. The engaging opening sidewall 531 is provided at one side of the stop position engaging opening 53, and the engaging opening protruding portion 532 protrudes from the other side of the stop position engaging opening 53. The engaging opening lug 533 protrudes from the bottom surface of the stop position engaging opening 53, arranged between the engaging opening sidewall 531 and the engaging opening protruding portion 532, which is rectilinear. The engaging opening slide groove 534 is formed at the bottom surface of the stop position engaging opening 53, and is located at one side or both sides of the engaging opening lug 533, preferably one side in the present embodiment.

At the last stop position, each stop position engaging opening 53 includes an engaging opening sidewall 531 and an arc recess 535. The stop position engaging opening 53 is provided with the engaging opening sidewall 531 at one side, and with the arc recess 535 at an edge of the other side, whose shape and size correspond to those of the arch portion 523.

The two base angles of the longitudinal cross-section of the stop piece protruding portion 522 are rounded angles; the two vertex angles of the longitudinal cross-section of the engaging opening protruding portion 532 are rounded angles, such that the stop piece 52 is slidable from one stop position engaging opening to another stop position engaging opening.

An included angle between the side surface of the strip-shaped portion 521 and the top plane 4411 of the first driving plate is referred to as a first included angle; an included angle between the engaging opening sidewall 531 and the top plane 4411 of the first driving plate is referred to as a second included angle; the first included angle is equal to the second included angle; the first included angle or the second included angle has a range of 60 to 80 degrees. When the bottom of the driving base plate 443 is unstressed, under an action of the elastic member 47, the stop piece 52 will slide out smoothly from the stop position engaging opening 53.

When the blade holder 2 is moved, the top lug 4412 or the engaging opening lug 533 slide in the slide groove 524 of the stop piece; the stop piece protruding portion 522 slides in the top slide groove 4413 or the slide groove 534 of the engaging opening. Specifically, when the bottom of the driving base plate 443 is stressed, the blade holder 2 is driven to move forwards (in a direction of the blade exit portal 18), the top lug 4412 slides in the slide groove 524 of the stop piece, and the stop piece protruding portion 522 slides in the top slide groove 4413, such that the stop piece 52 is snapped in the first stop position engaging opening, and the top lug 4412 is snapped in the slide groove 524 of the stop piece; the stop piece protruding portion 522 is snapped in the slide groove 534 of the engaging opening. At this point, the blade 3 protrudes out of the blade exit portal 18 by a small distance. The user may exert a force at the bottom of the driving member 44 as needed, and pushes out the blade 3 again, such that the stop piece 52 slides out of the first stop position engaging opening into the second stop position engaging opening or the third stop position engaging opening. By this time, the blade 3 protrudes out of the blade exit portal 18 by a relatively long distance. The protrusion length of the blade 3 varies correspondingly with the stop position engaging opening in which the stop piece 52 is snapped.

Since the stop position engaging opening 53 and the through hole 444 of the first driving plate are parts of the first driving plate 44, the distance by which the stop piece 52 slides with respect to the first driving plate 441 is directly proportional to the distance by which the driving shaft pin 446 slides in the two through holes 444 and 445 of the driving plates. Since the driving shaft pin 446 pushes the blade holder 2 through the second lever 46, the distance by which the driving shaft pin 446 slides in the two through holes 444 and 445 of the driving plates towards the blade exit portal 18 is directly proportional to the distance by which the blade holder 2 moves towards the blade exit portal 18. Since the length of the blade 3 extending outside the cutting tool housing 1 is directly proportional to the distance by which the blade holder 2 moves towards the blade exit portal 18, the length of the blade 3 extending outside the cutting tool housing 1 is directly proportional to the distance by which the stop piece 52 moves with respect to the first driving plate 44. The user can control the protrusion length of the blade 3 outside the cutting tool housing 1 by controlling the position of the stop piece 52 at the stop position engaging opening 53 or the top of the first driving plate 44.

If the force exerted by the user to the bottom of the driving member 44 is reduced, the stop piece 52 slides from the third stop position engaging opening to the second stop position engaging opening, or slides from the second stop position engaging opening to the first stop position engaging opening. In short, the user may adjust the length of the blade 3 extending out of the blade exit portal 18 according to a magnitude of the force exerted to the bottom of the driving member 44 by him or herself, which is simple and convenient. When the stop piece 52 falls in a certain stop position engaging opening 53, the blade holder 2 is in a relatively stable condition. The protrusion length of the blade 3 is unchanged in a short time as long as the force exerted by the user is constant. When the hand of the user is released from the bottom of the driving member 44, the blade 3 is completely retracted into the cavity 13 of the cutting tool housing 1, without safety hazard after use.

Figure 5:
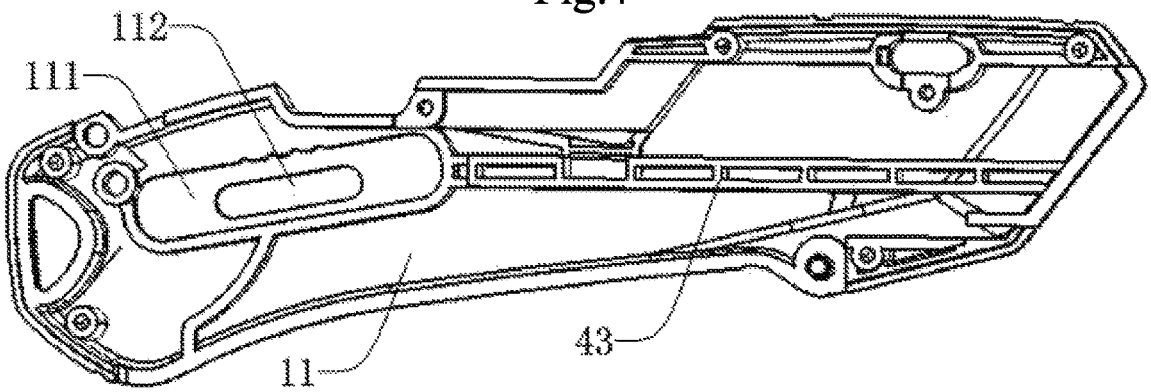
FIG. 5 is a structural schematic diagram of an inner side of the first housing in the first embodiment according to the present invention.
Figure 13:
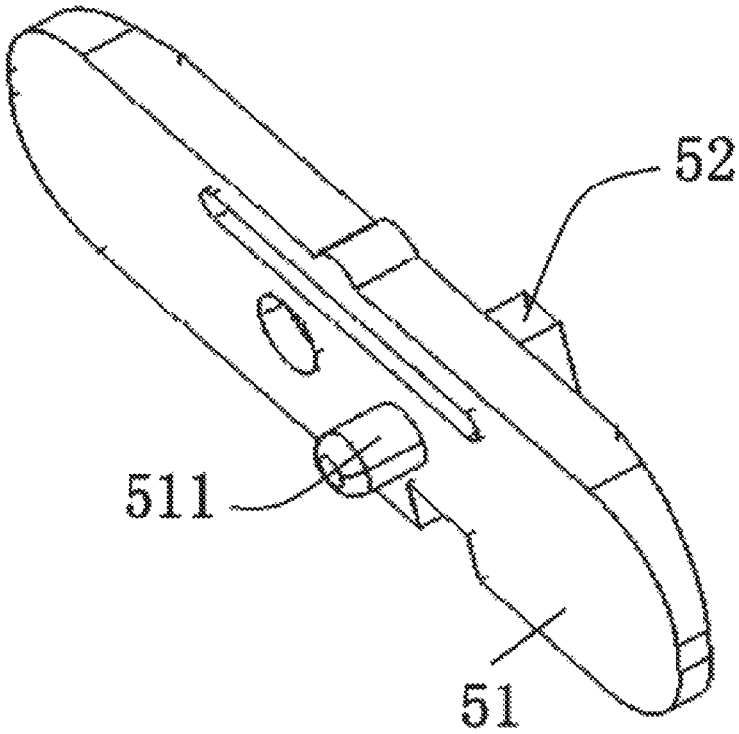
FIG. 13 is a structural schematic diagram of a front surface of the locking sheet in the first embodiment according to the present invention.

As shown in FIGS. 5 and 13, the protrusion length control device 5 further includes a stop position hole 112 and a stop position lever 511. The stop position hole 112 penetrates through the sidewall of the first housing 11, disposed opposite the locking sheet 51. The stop position lever 551 protrudes from the locking sheet 51 towards the surface of one side of the first housing 11, sliding in the stop position hole 112. The stop position lever 511 and the stop piece 52 are disposed opposite each other at the both sides of the locking sheet 51, the position of the stop position lever 511 corresponding to that of the stop piece 52. As shown in FIG. 9, the protrusion length control device 5 further includes a lock button 54, arranged outside the first housing 11, and fixed to the locking sheet 51 or the stop position lever 511. The locking sheet 51 and the stop piece 52 have an integrated structure, and the identical movement locus. The lock button 54 is fixed to the locking sheet 51 and/or the stop position lever 511. Preferably, the lock button 54 is fixed to the locking sheet 51 through a screw, so the lock button 54 also has the same movement locus as the stop piece 52. The user may control the protrusion length of the blade 3 accurately according to the position where the lock button 54 is located.

Figure 14:
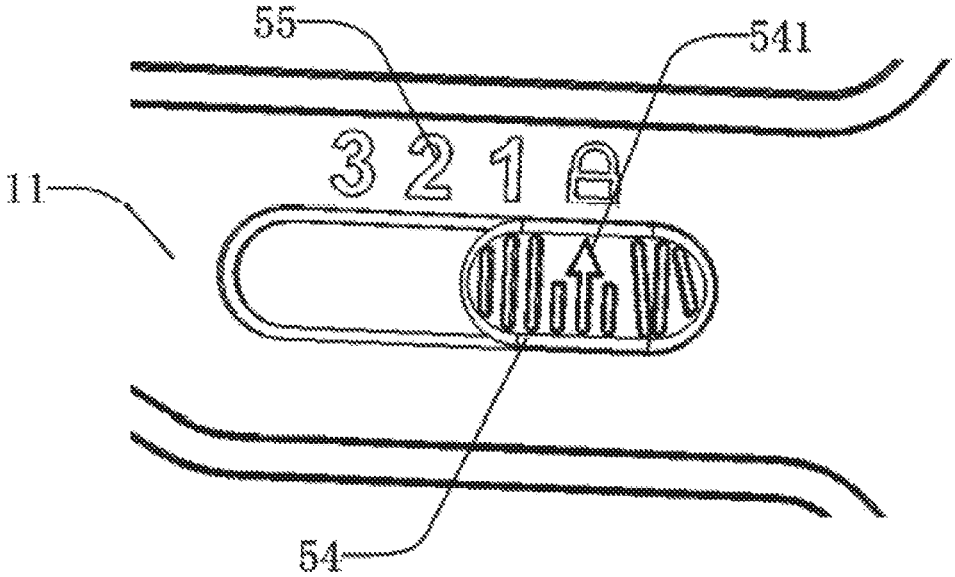
FIG. 14 is a structural schematic diagram of a stop position mark and an indicator arrow in the first embodiment according to the present invention.

As shown in FIG. 14, the protrusion length control device 5 further includes a stop position mark 55 and an indicator arrow 541, the stop position mark 55 arranged at an outer surface of the first housing 11, corresponding to the stop position hole 112, and disposed near the stop position hole 112. In the present embodiment, the stop position hole 112 is preferably rectilinear, and the stop position mark 55 is labeled near the stop position hole 112, for labeling the position of the stop piece 52. The indicator arrow 541 is provided at the surface of the stop position lever 511 or the lock button 54, corresponding to any one stop position mark. The indicator arrow 541 is matched with the stop position mark 55, for representing the position of the stop position lever 511 in the stop position hole 112. The position of the stop position lever 511 in the stop position hole 112 corresponds to that of the stop piece 52 at the stop position engaging opening 53 or the top of the first driving plate 44. Since stop piece 52 is provided in the cutting tool housing 1, it is invisible outside the cutting tool housing 1. Therefore, the user can control the protrusion length of the blade 3 outside the cutting tool housing 1 by only controlling the position of the stop position lever 511 in the stop position hole 112.

When the stop piece 52 is located at the top of the first driving plate 441, the indicator arrow 541 points to the scale of 0 (denoted by a lock-shaped symbol in the present embodiment), and the blade 3 is retracted into the cutting tool housing 1; when the stop piece 52 is located at the first stop position engaging opening, the indicator arrow 541 points to the scale of 1, and the front end of the blade 3 protrudes slightly out of the cutting tool housing 1; when the stop piece 52 is located at the second stop position engaging opening, the indicator arrow 541 points to the scale of 2, and the blade 3 protrudes out of the cutting tool housing 1 to a greater degree; when the stop piece 52 is located at the third stop position engaging opening, the indicator arrow 541 points to the scale of 3, and the blade 3 mostly protrudes out of the cutting tool housing 1. During the use of the present embodiment, the user may accurately control the protrusion length of the blade 3 as needed with reference to the specific scale to which the indicator arrow 541 points.

The present invention has the beneficial effects that the present invention provides a retractable cutting tool, the blade of which is retractable in use, which is convenient for the user to adjust the length of the blade in a service condition as needed, with simple operation, convenient use and good user experience. In the present invention, the blade after use is automatically withdrawable to the hand-held portion, which improves the safety performance of the cutting tool, and has a stable structure and relatively long service life.

Second Embodiment

The first embodiment has the disadvantage that the blade 3 itself is a consumable, and tends to be oxidized or get rusty after long-time use, or be damaged due to misuse of the user although the blade retraction control device 5 has a relatively stable structure and relatively long service life.

In order to solve the above problems, the present embodiment provides a retractable cutting tool, including all technical features of the first embodiment as well as the following each feature.

Figure 15:
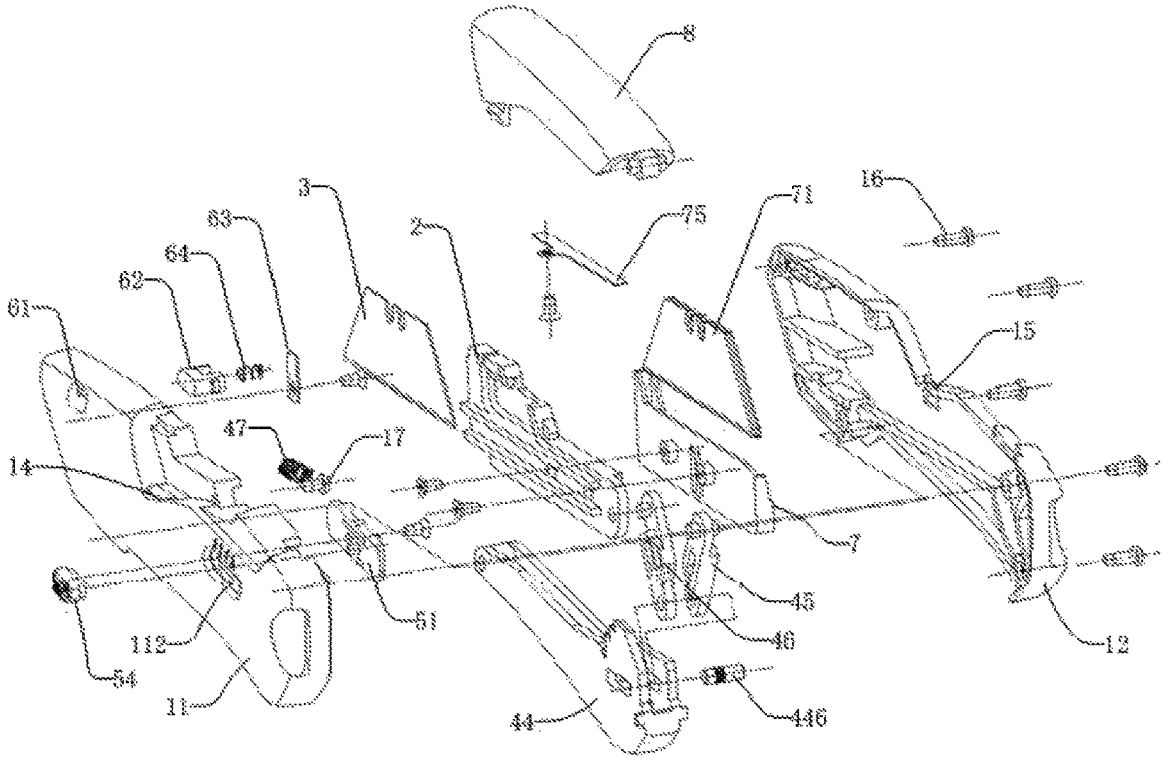
FIG. 15 is an exploded structural schematic diagram of the second embodiment according to the present invention.
Figure 16:
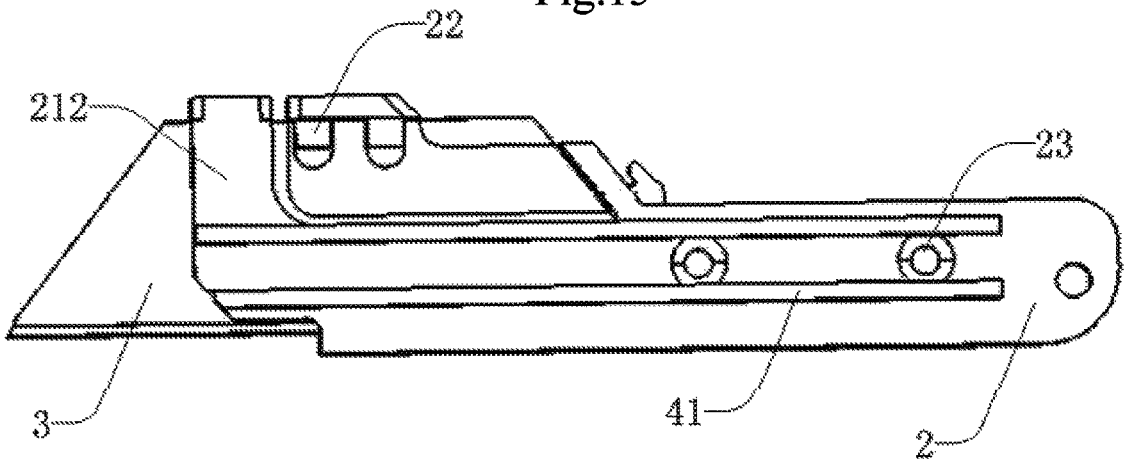
FIG. 16 is a structural schematic diagram of one side subsequent to the assembly of the blade holder and the blade in the second embodiment according to the present invention.

As shown in FIGS. 15-16, the blade latch slot 21 includes a first L-shaped blade baffle 211 and a second L-shaped blade baffle 212, the first L-shaped blade baffle 211 disposed opposite a middle portion and a rear end of the blade 3; the second L-shaped blade baffle 212 disposed opposite a front end of the blade 3; the first blade baffle 211 and the second blade baffle 212 are arranged at both sides of the blade 3 respectively; the blade locking block 22 is provided at the inner side surface of the first blade baffle 211, for locking the blade 3 and preventing the blade 3 from sliding in the blade latch slot 21.

Figure 17:
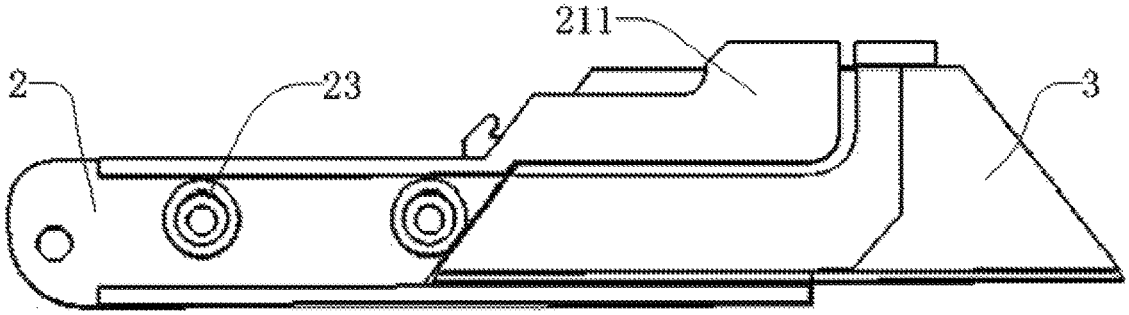
FIG. 17 is a structural schematic diagram of the other side subsequent to an assembly of the blade holder and the blade in the second embodiment according to the present invention.
Figure 18:
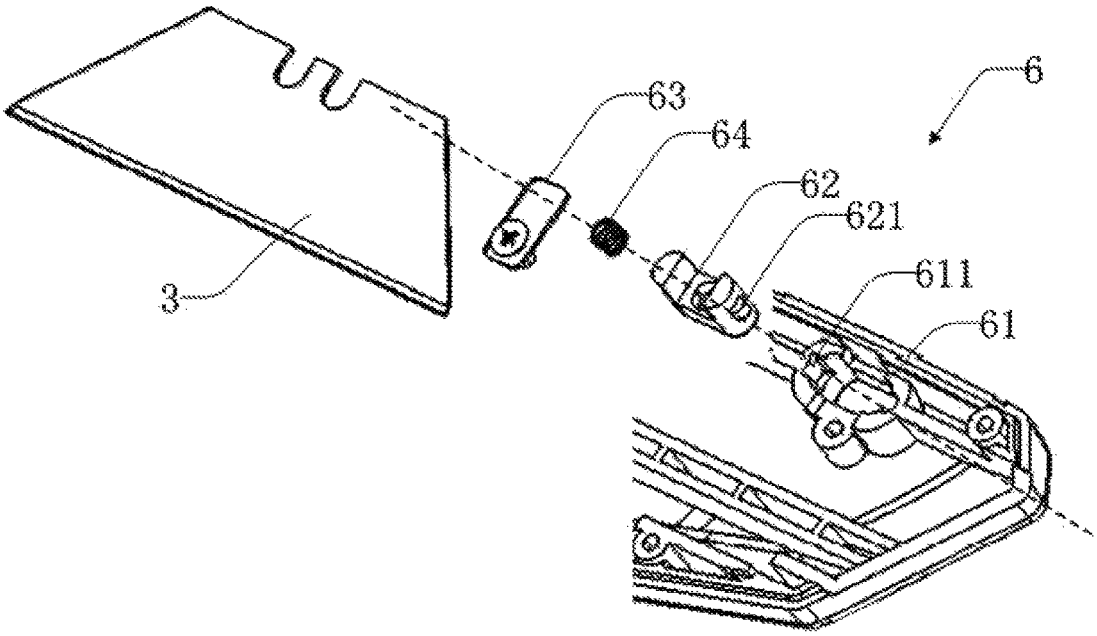
FIG. 18 is an exploded structural schematic diagram of a blade changing device in the second embodiment according to the present invention.

As shown in FIGS. 15 and 17, the retractable cutting tool further includes a blade changing device 6, for detaching the blade 3 from the blade holder 2, or for mounting the blade 3 to the blade holder 2.

The blade changing device 6 includes a blade changing button mounting hole 61, a blade changing button 62, a blade changing gasket 63 and a blade changing elastic member 64. The blade changing button mounting hole 61 is arranged at the front end of the first housing 11, and penetrates through the first housing 11; the blade changing button 62 is mounted into the blade changing button mounting hole 61; the blade changing gasket 63 is fixed to an inner surface of the first housing 11, disposed opposite the front end of the blade 3; one end of the blade changing elastic member 64 (preferably, a spiral spring) is connected to the blade changing button 62, and the other end thereof is connected to the blade changing gasket 63. An inner sidewall of the blade changing button mounting hole 61 is provided with a button slide groove 611; an outer sidewall of the blade changing button 62 is provided with a protruding button sliding block 621, snapped into the button slide groove 611; in the present embodiment, two button sliding blocks 621 disposed to each other and two button slide grooves 611 disposed to each other are preferable.

When the blade changing button 62 is pressed, the button sliding block 621 slides in the button slide groove 611, and the blade changing gasket 63 pushes the front end of the blade 3. Since the first blade baffle 211 and the second blade baffle 212 are arranged in a staggered manner to seize the blade 3, when the blade 3 is stressed by a trust force perpendicular to the surface of the blade, the front end of the blade 3 would laterally deflects, and the middle part and the rear end of the blade 3 would also laterally deflect, thereby releasing the blade 3 from the blade holder 2. Similarly, the spare blade may be mounted into the blade holder 2 using the blade changing device 6.

The present embodiment has the beneficial effects that the blade 3 is separable from the blade holder 2, which is convenient for the user to detach and change the blade, further prolonging the service life of the retractable cutting tool. The solution has the disadvantage that the spare blade and the retractable cutting tool are placed separately, which may cause the spare blade to be lost. In order to solve this problem, the present embodiment further provides the following technical solution.

Figure 19:
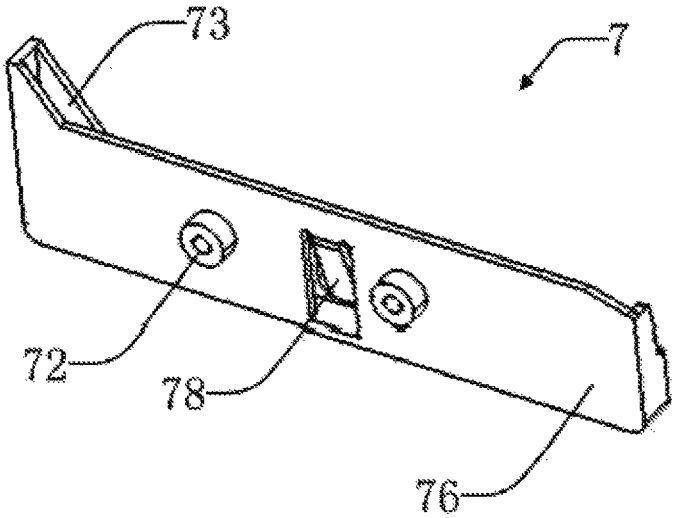
FIG. 19 is a structural schematic diagram of one side of a blade magazine in the second embodiment according to the present invention.
Figure 20:
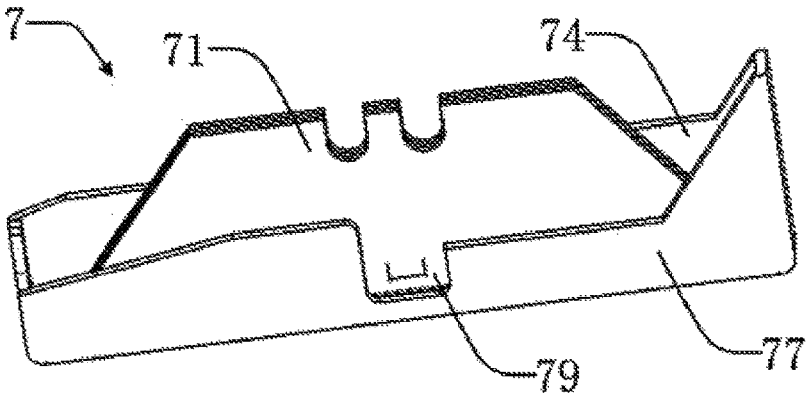
FIG. 20 is a structural schematic diagram of the other side of the blade magazine and a spare blade in the second embodiment according to the present invention.

As shown in FIGS. 15, 19-20, the present embodiment may further include a blade magazine 7 and a spare blade 71, mounted into the cavity 13 of the cutting tool housing 1. The blade magazine 7 is fixed to the blade holder 2; and the spare blade 71 is put in the blade magazine 2.

The side surface of the blade holder 2 towards the first housing 11 is provided with two parallel rectilinear guide rails 41, and the other side surface is mountable with the blade magazine 7. Specifically, the surface of the blade magazine 7 close to the blade holder 2 side is provided with two protruding screw holes 72, the blade holder 2 is provided with two blade holder through holes 23 corresponding to the screw holes, and the two screws pass through the blade holder through hole 23 to be fixed to the screw holes 72, thereby fixedly connecting the blade magazine 7 with the blade holder 2. The interior of the blade magazine 7 forms a blade magazine hollow cavity 73, for placing one or more spare blades 71. The blade magazine 7 is provided with one blade magazine opening 74 at the top, where one cover plate of the blade magazine 75 is mounted, to prevent the spare blade 71 from sliding down in use of the cutting tool. The blade magazine 7 includes a first blade magazine sidewall 76 and a second blade magazine sidewall 77, the middle part of the first blade magazine sidewall 76 is provided with one blade magazine spring sheet 78, bending inwards the blade magazine 7, for abutting the spare blade 71 at the inner side of the second blade magazine sidewall 77, and the spare blade 71 would not slide out of the blade magazine 7 by means of a friction force between the second blade magazine sidewall 77 and the spare blade 71. The second blade magazine sidewall 77 is provided with a sidewall notch 79 in the middle, which is convenient for the user to take the spare blade 71 out of the blade magazine 7.

In the present embodiment, the cover plate 75 of the blade magazine is fixed to the cap 8 through one screw. When the user inwards presses at the both sides of the cap 8, the first cap plate 81 and the second cap plate 82 are deformed inwards, such that the first snap latch 83 is released from the first housing latch slot 14, and the second snap latch 84 from the second housing latch slot 15, thereby separating the cap 8 from the first housing 11 and the second housing 12. Since the cover plate 75 of the blade magazine is fixed to the cap 8, the cover plate 75 of the blade magazine would be separated from the blade magazine opening 74, thereby taking out the spare blade 71. After the spare blade 71 is taken out, the cap 8 is remounted to the cutting tool housing 1. Subsequently, the user presses the blade changing button 62, takes out the blade 3 in the blade holder 2, and mounts the spare blade into the blade holder 2.

The present embodiment has the beneficial effects that the present invention provides a retractable cutting tool, the blade of which is retractable in use, which is convenient for the user to adjust the length of the blade in a service condition as needed, with simple operation and convenient use. The blade after use is automatically withdrawable to the hand-held portion, which improves the safety performance of the cutting tool. The blade in the present embodiment is exchangeable, is simply and conveniently detached and mounted, and has a relatively long service life.

Third Embodiment

The first and the second embodiments have the disadvantage that when the cutting tool is not used, if the user touches the bottom of the driving member 44 by mistake, the front end of the blade 3 would extend out, and expose outside the cutting tool housing 1, with certain safety risks.

In order to solve the above problems, the present embodiment provides a retractable cutting tool, including all technical features of the first and the second embodiments as well as the following each feature.

Figure 21:
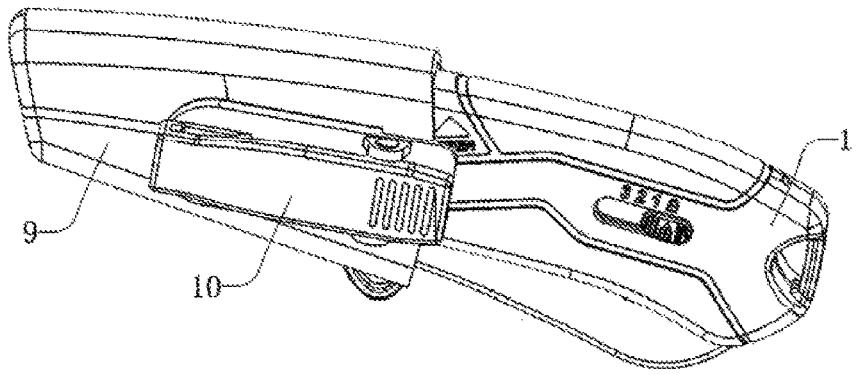
FIG. 21 is an overall structural schematic diagram of the third embodiment according to the present invention.

As shown in FIG. 21, in the present embodiment, the retractable cutting tool further includes a blade sheath 9, detachably connected to the cutting tool housing 1, and disposed opposite the blade exit portal 18 with the blade sheath 9 connected to the cutting tool housing 1.

Figure 22:
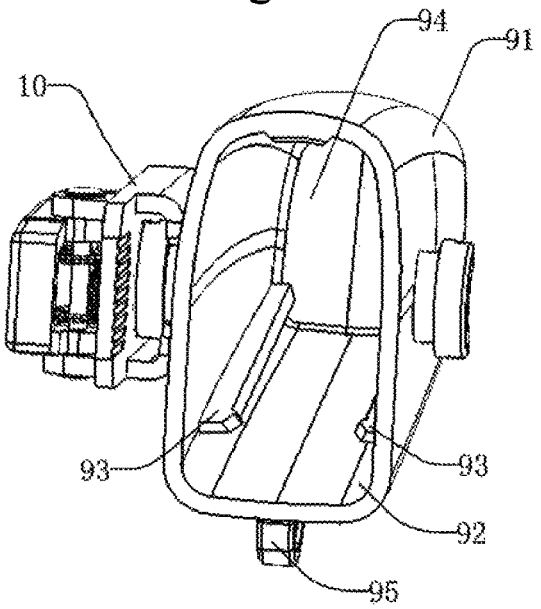
FIG. 22 is a structural schematic diagram of a blade sheath and a blade sheath clamp in the third embodiment according to the present invention.

As shown in FIG. 22, the blade sheath 9 includes a blade sheath body 91, a blade sheath opening 92 and a blade sheath clamping strip 93. The blade sheath body 91 is provided therein with a blade sheath cavity 94; the blade sheath opening 92 is arranged at the surface of the blade sheath body 91, the cutting tool housing 1 moves in and out of the blade sheath cavity 94 via the blade sheath opening 92; the blade sheath clamping strip 93 is rectilinear, protruding from the inner side surface of the blade sheath body 91, for clamping to the outer surface of the cutting tool housing 1. When the cutting tool housing 1 enters in the blade sheath cavity 94 by a certain distance, that is after reaching an interference position on the blade sheath clamping strip 93, the cutting tool housing 1 is locked by a pre-tightening force of the blade sheath clamping strip 93, such that the cutting tool housing 1 is not released from the blade sheath 9 with the stressed outward tension less than the pre-tightening force. When the outward tension of the cutting tool housing 1 is larger than the pre-tightening force, the cutting tool housing 1 is not released from the blade sheath 9. When the cutting tool is not used, as long as the user mounts the blade sheath 9 to the cutting tool housing 1, the front end of the blade 3 would not extend out due to touching the driving member 44 by mistake, with relatively good safety. The blade sheath 9 further includes a hanging eye 95, arranged at the outer surface of the blade sheath body 91, for hanging the blade sheath 9 somewhere.

In order to conveniently carry the retractable cutting tool, the present embodiment further includes a blade sheath clamp 10, rotatably and/or detachably connected to the blade sheath 9. In the present embodiment, the blade sheath clamp 10 is preferably rotatably and detachably connected to the blade sheath 9.

Figure 23:
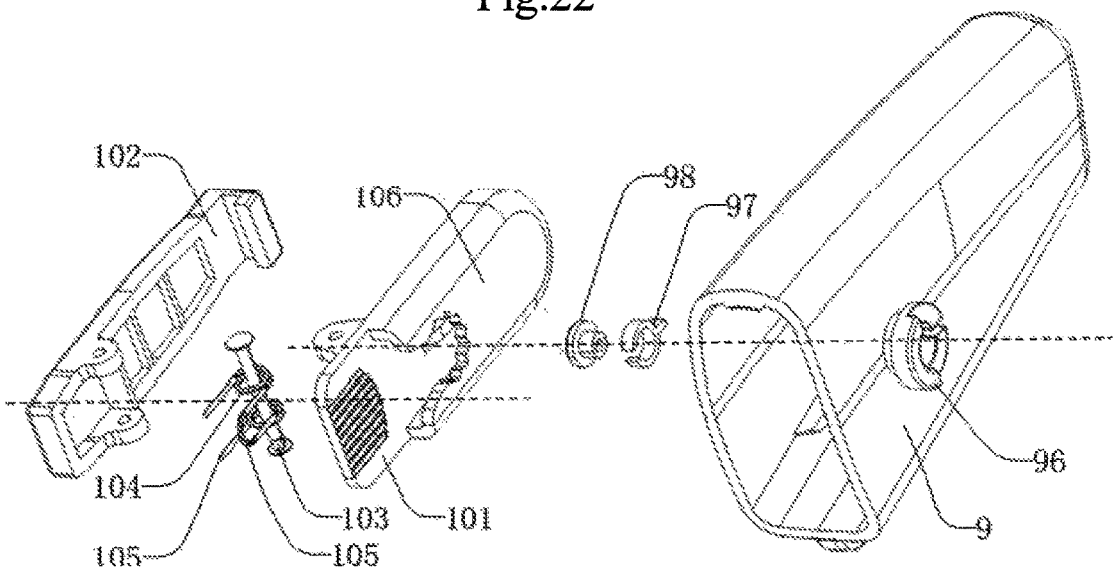
FIG. 23 is an exploded structural schematic diagram of the blade sheath and the blade sheath clamp in the third embodiment according to the present invention.

As shown in FIG. 23, the blade sheath clamp 10 includes a first clamping plate 101, a second clamping plate 102, a shaft pin 103 of the clamping plate, and a torsional spring 104 of the clamping plate. The second clamping plate 102 is disposed opposite the first clamping plate 101; the first clamping plate 101 is hinged to the second clamping plate 102 through the shaft pin 103 of the clamping plate; the torsional spring 104 of the clamping plate blade sheaths the shaft pin 103 of the clamping plate, including two supporting ends 105 for supporting the first clamping plate 101 and the second clamping plate 102 respectively. The first clamping plate 101 and the second clamping plate 102 form the clamp, which can clip the cutting tool on the user's waistband, which is convenient to carry.

Figure 24:
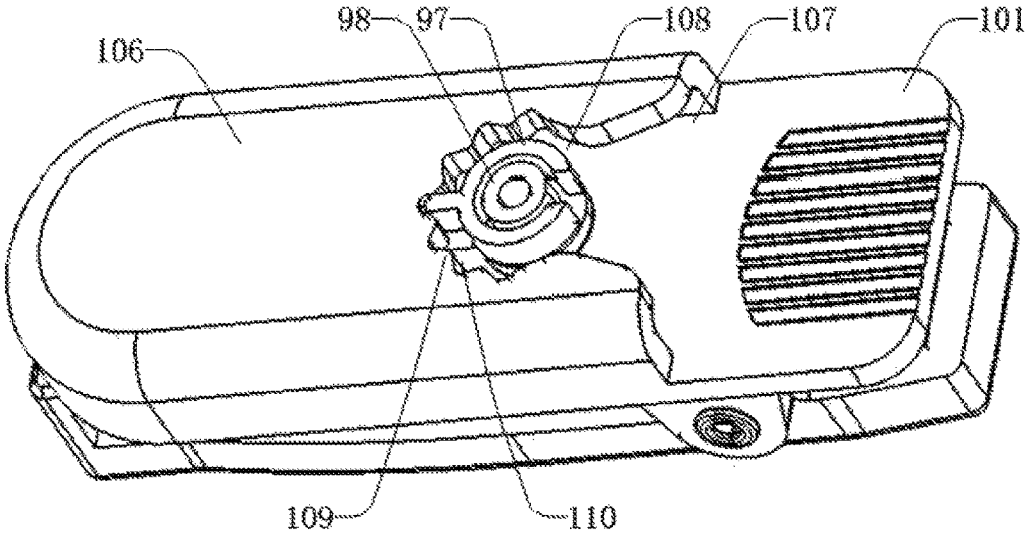
FIG. 24 is a structural schematic diagram of a clamp casing in the third embodiment according to the present invention.

As shown in FIG. 24, the blade sheath clamp 10 further includes a clamp casing 106, a casing opening 107, a casing through hole 108 three or more casing sliding teeth 109. The clamp casing 106 is provided at the surface of the blade sheath clamp 10, forming a casing hollow cavity with the surface of the blade sheath clamp 10. In the present embodiment, the clamp casing 106 is preferably arranged at the surface of the first clamping plate 101, the casing hollow cavity is formed between the clamp casing 106 and the surface of the first clamping plate 101; the casing opening 107 is arranged at one end of the clamp casing 106; the casing through hole 108 penetrates through the clamp casing 106, close to and communicating with the casing opening 107; the casing sliding teeth 109 protrude from and uniformly distribute at the inner sidewall of the casing through hole 106, and a casing sliding tooth space 110 is formed between any two adjacent casing sliding teeth 109.

Figure 25:
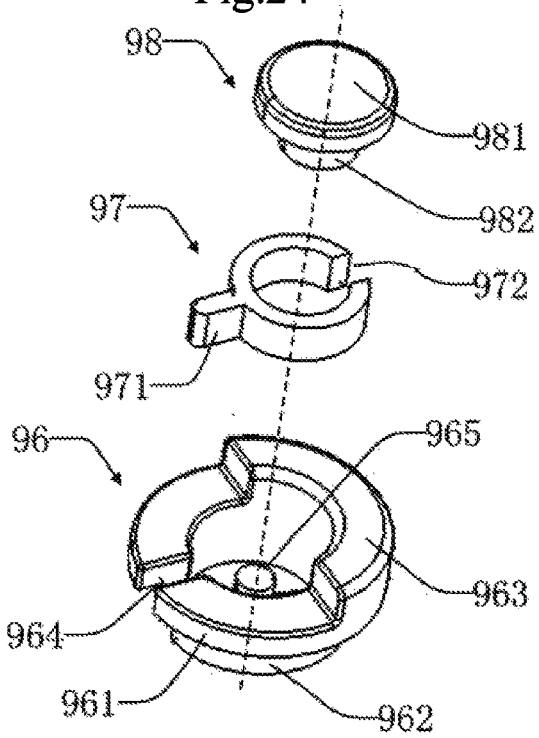
FIG. 25 is an exploded structural schematic diagram subsequent to the assembly of a blade sheath snap ring, an elastic snap collar and an elastic snap stopper in the third embodiment according to the present invention.
Figure 26:
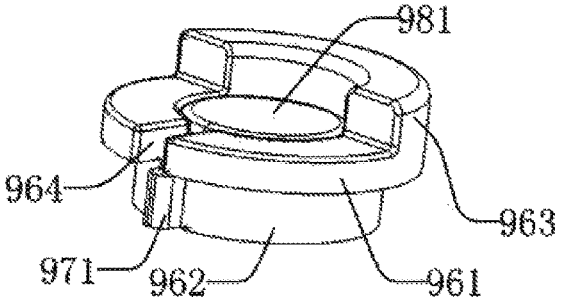
FIG. 26 is an overall structural schematic diagram subsequent to the assembly of the blade sheath snap ring, the elastic snap collar and the elastic snap stopper in the third embodiment according to the present invention.

As shown in FIGS. 23, 25-26, the blade sheath 9 includes a blade sheath clamping ring 96, protruding from the outer surface of the blade sheath 9, with a ring shape; the number of the blade sheath clamping ring 96 may be one or two, the blade sheath clamping ring 96 integrated with the blade sheath body 91, protruding from the surface of one side or both sides of the blade sheath 9. In the present embodiment, two blade sheath clamping rings 96 are preferable, which is convenient for the user to mount the blade sheath clamp 10 on any one side surface of the blade sheath 9, such that the blade sheath clamp 10 is mounted more flexibly.

The blade sheath clamping ring 96 includes a clamping ring base 961, which is provided with a clamping ring body 962 at one side thereof towards the blade sheath 9, and is provided with a protruding clamping ring stop piece 963 at the other side, snapped to the casing through hole 108. The clamping ring stop piece 963 has a semi-ring shape, with an inner diameter and an outer diameter constant with those of the ring of the clamping ring body 962. The clamping ring base 961, the clamping ring body 962 and the clamping ring stop piece 963 are integrated. The sidewall of the clamping ring body 962 is provided with a sliding tooth opening 964, for mounting the elastic snap collar 97; the blade sheath clamping ring 96 is centrally provided with a snap stopper mounting pillar 965, protruding from the outer surface of the blade sheath 9, for mounting the elastic snap stopper 98.

As shown in FIGS. 23-26, the retractable cutting tool according to the present embodiment further includes an elastic snap collar 97, mounted into the blade sheath clamping ring 96. The elastic snap collar 97 specifically includes a snap collar sliding tooth 971 and a snap collar opening 972, the snap collar sliding tooth 971 protruding from the outer sidewall of the elastic snap collar 97, and passing through the sliding tooth opening 961 to be snap-fitted to any one casing sliding tooth space 110; the snap collar opening 972 is arranged at the sidewall of the elastic snap collar 97 which is disconnected at the snap collar opening 972, the elastic snap collar 97 may be slightly deformed, and its diameter is slightly adjustable. When the blade sheath 9 and the blade sheath clamp 10 are fixed relatively to each other, the snap collar sliding tooth 971 is snap-fitted into a certain casing sliding tooth space 110. The elastic snap collar 97 is an annular thin sheet made of a metal material, disconnected at the snap collar opening 972 and may be slightly deformed. When the user exerts a force on the blade sheath 9 and the blade sheath clamp 10 respectively by hands and the blade sheath 9 is rotated with respect to the blade sheath clamp 10, the snap collar sliding tooth 971 would slide from one casing sliding tooth space 110 to another casing sliding tooth space 110, with rhythmed sounds during sliding.

As shown in FIGS. 23-26, the retractable cutting tool according to the present embodiment further includes an elastic snap stopper 98, mounted into the blade sheath clamping ring 96. The elastic snap stopper 98 includes a snap stopper base 981 and a snap stopper sleeve 982. The snap stopper base 981 is provided in the casing hollow cavity 108, the snap stopper sleeve 982 protrudes from the middle of the snap stopper base 981, blade sheathing the snap stopper mounting pillar 91, for mounting the blade sheath clamping ring 96 and the elastic snap collar 97 to the casing through hole 108, and the elastic snap stopper 98 is fixed to the blade sheath clamping ring 96, such that the elastic snap collar 97 is not released from the blade sheath 9. After the elastic snap stopper 98 is unplugged, the blade sheath clamp 10 may be separated from the blade sheath 9. The user may select the side surface of the blade sheath on which the blade sheath clamp 10 is mounted by him or herself as appropriate.

The present embodiment has the beneficial effects that the present invention provides a retractable cutting tool, the blade of which is retractable in use, which is convenient for the user to adjust the length of the blade in a service condition as needed, with simple operation and convenient use. In the present invention, the blade sheath is additionally provided, which further reduces safety risks of operation; in the present embodiment, the rotatable and detachable blade sheath clamp is further arranged, with flexible operation, convenient assembly and portability.

The invention has been exemplified above with reference to specific embodiments. However, it should be understood that a multitude of modifications and variations can be made by a common person skilled in the art based on the conception of the present invention. Therefore, any technical schemes, acquired by the person skilled in the art based on the conception of the present invention through logical analyses, deductions or limited experiments, fall within the scope of the invention as specified in the claims.

The invention claimed is:

1. A retractable cutting tool, comprising:

a cutting tool housing, an interior of which forms a cavity;

a blade exit portal penetrating through a front end of the cutting tool housing and communicating with the cavity;

a blade holder moved or locked in the cutting tool housing;

a blade assembled to the blade holder; when the blade holder is moved, a front end of the blade protrudes out of the cutting tool housing or retracts into the cutting tool housing through the blade exit portal;

a first device for moving the blade holder in the cutting tool housing; and a second device for controlling a protrusion length of the blade outside the cutting tool housing, wherein the cutting tool housing includes a first housing portion, wherein the first device includes a driving member, the driving member including a first driving plate and a driving base plate, and wherein the second device comprises:

a locking sheet, sliding in a slide groove of an inner sidewall of the first housing portion, a stop piece, protruding from a surface of the locking sheet towards the driving member, and at least one stop position engaging opening, arranged at an edge of the first driving plate of the driving member;

when the driving base plate of the driving member is stressed, the stop piece can slide to any one of the at least one stop position engaging opening;

a stop position hole, penetrating through a sidewall of the first housing portion and disposed opposite the locking sheet;

wherein the second device further comprises:

a stop position lever, protruding from a surface of the locking sheet towards the first housing portion and sliding in the stop position hole, and a lock button, arranged outside the first housing portion and connected to the stop position lever; and a stop position mark, provided at an outer surface of the first housing portion and corresponding to the stop position hole.

2. The retractable cutting tool according to claim 1, wherein the first housing portion is provided with a first housing latch slot and the cutting tool housing further comprises:

a second housing portion, provided with a second housing latch slot, the second housing portion disposed opposite the first housing portion; and a cap, detachably connected to the first housing portion and/or the second housing portion;

wherein the cap comprises:

a first cap plate, provided with a protruding first snap latch at a bottom thereof that is snap-fitted to the first housing latch slot; and a second cap plate, disposed opposite the first cap plate and provided with a protruding second snap latch at a bottom thereof that is snap-fitted to the second housing latch slot.

3. The retractable cutting tool according to claim 1, wherein the first device comprises:

two parallel rectilinear guide rails protruding from one side surface of the blade holder;

a guide rail gap formed between the two guide rails; and a housing sliding block, protruding from an inner sidewall of the cutting tool housing towards the blade holder and snapped into the guide rail gap; when the blade holder is moved, the housing sliding block slides with respect to the two guide rails.

4. The retractable cutting tool according to claim 1, wherein one end of the driving member is hinged to the cutting tool housing, and the first driving plate is provided with a first driving plate through hole, and the driving member further comprises:

a second driving plate provided with a second driving plate through hole, disposed opposite the first driving plate through hole;

a driving shaft pin, one end of which is slidably mounted into the first driving plate through hole, and another end of which is slidably mounted into the second driving plate through hole; and wherein the driving base plate connecting the first driving plate and the second driving plate.

5. The retractable cutting tool according to claim 4, wherein the first device comprises:

a first lever, one end of which is hinged to the cutting tool housing, and another end of which is rotatably mounted to the driving shaft pin;

a second lever, one end of which is hinged to the blade holder, and another end of which is rotatably mounted to the driving shaft pin; and an elastic member, one end of which is connected to the cutting tool housing, and another end of which is connected to the blade holder.

6. The retractable cutting tool according to claim 5, wherein when the driving base plate is stressed, the driving shaft pin is pushed by the first lever to slide in the first driving plate through hole and the second driving plate through hole; the blade holder is pushed by the second lever to move towards the blade exit portal, and the elastic member is elastically deformed; and the length of the blade extending outside the cutting tool housing is directly proportional to a distance by which the blade holder moves towards the blade exit portal; and when the driving base plate is unstressed, the elastic member resiles to push the blade holder to move away from the blade exit portal.

7. The retractable cutting tool according to claim 1, wherein when the blade holder is moved, the stop piece slides at a top of the first driving plate or in any one of the at least one stop position engaging opening; and the length of the blade extending outside the cutting tool housing is directly proportional to a distance by which the stop piece slides; and when the blade holder is locked, the stop piece is selectively snap-fitted to any one of the at least one stop position engaging opening, or away from or tangent to the top of the first driving plate; the length of the blade extending outside the cutting tool housing corresponds to a position of the stop piece.

8. The retractable cutting tool according to claim 1, wherein the stop piece comprises the following that are integrally formed:

a strip-shaped portion having a parallelogram cross-section;

a stop piece protruding portion, being at a bottom of the strip-shaped portion, two base angles of a cross-section of the stop piece protruding portion being rounded angles; and an arch portion having an arch cross-section, the arch portion being a side of the strip-shaped portion;

wherein a slide groove is formed in the locking sheet.

9. The retractable cutting tool according to claim 1, wherein the at least one stop position engaging opening comprises:

an engaging opening sidewall, arranged at one side of the stop position engaging opening;

an engaging opening protruding portion protruding from the other side of the stop position engaging opening;

an engaging opening lug, protruding from a bottom surface of the stop position engaging opening and provided between the engaging opening sidewall and the engaging opening protruding portion; and an engaging opening slide groove, formed at the bottom surface of the stop position engaging opening and located at one side or both sides of the engaging opening lug;

or, the at least one stop position engaging opening comprises:

an engaging opening sidewall, provided at one side of the stop position engaging opening;

an arc recess, arranged at the other side of the stop position engaging opening.

10. The retractable cutting tool according to claim 1, further comprising:

a blade latch slot, arranged at an upper portion of the blade holder, whose shape corresponds to that of the blade;

a blade engaging opening, arranged at a ridge of the blade; and a blade locking block, protruding from an inner surface of the blade latch slot, and snap-fitted to the blade engaging opening.

11. The retractable cutting tool according to claim 10, wherein the blade latch slot comprises:

a first blade baffle, which is L-shaped and disposed opposite a middle portion and a rear end of the blade;

a second blade baffle, which is L-shaped and disposed opposite a front end of the blade;

wherein the first blade baffle and the second blade baffle are arranged at both sides of the blade respectively; and the blade locking block protrudes from an inner side surface of the first blade baffle.

12. The retractable cutting tool according to claim 1, further comprising:

a third device, for detaching the blade from the blade holder, or for mounting the blade to the blade holder.

13. The retractable cutting tool according to claim 12, wherein the third device comprises:

a blade changing button mounting hole, arranged at a front end of the first housing portion and penetrating through the first housing an inner sidewall of the blade changing button mounting hole is provided with a button slide groove;

a blade changing button, mounted into the blade changing button mounting hole; an outer sidewall of the blade changing button is provided with a protruding button sliding block that is snapped into the button slide groove;

a blade changing gasket, fixed to an inner surface of the first housing portion and disposed opposite a front end of the blade; and a blade changing elastic member, one end of which is connected to the blade changing button, and the other end of which is connected to the blade changing gasket; when the blade changing button is pressed, the button sliding block slides in the button slide groove, and the blade changing gasket pushes the front end of the blade.

14. The retractable cutting tool according to claim 1, further comprising:

a blade magazine, fixed to the blade holder; and a spare blade, disposed in the blade magazine.

15. The retractable cutting tool according to claim 14, wherein the blade magazine comprises:

a first blade magazine sidewall;

a second blade magazine sidewall, disposed opposite the first blade magazine sidewall;

a blade magazine opening, arranged at a top of the blade magazine;

a blade magazine spring sheet, arranged at an inner side of the first blade magazine sidewall and bending towards an inner side of the blade magazine;

a sidewall notch, penetrating through the second blade magazine sidewall; and a blade magazine cover plate, mounted to the blade magazine opening and connected to the cap.

16. The retractable cutting tool according to claim 1, further comprising:

a blade sheath, detachably connected to the cutting tool housing and disposed opposite the blade exit portal.

17. The retractable cutting tool according to claim 16, wherein the blade sheath comprises:

a blade sheath body, which is provided with a blade sheath cavity therein;

a blade sheath opening, arranged at a surface of the blade sheath body, the cutting tool housing moves in and out of the blade sheath cavity via the blade sheath opening; and a blade sheath clamping strip, protruding from an inner surface of the blade sheath body, for being snap-fitted to an outer surface of the cutting tool housing.

18. The retractable cutting tool according to claim 16, further comprising:

a blade sheath clamp, rotatably and/or detachably connected to the blade sheath.

19. The retractable cutting tool according to claim 18, wherein the blade sheath clamp comprises:

a first clamping plate;

a second clamping plate, disposed opposite the first clamping plate;

a clamping plate shaft pin, through which the first clamping plate is hinged to the second clamping plate;

a clamping plate torsional spring, provided around outside of the clamping plate shaft pin and comprising two supporting ends for supporting the first clamping plate and the second clamping plate respectively;

a clamp casing, arranged at a surface of the blade sheath clamp and forming a casing hollow cavity together with the surface of the blade sheath clamp;

a casing opening, arranged at one end of the clamp casing;

a casing through hole, penetrating through the clamp casing, being adjacent to and communicating with the casing opening; and two or more casing sliding teeth, protruding from and uniformly distributed around an inner sidewall of the casing through hole, a casing sliding tooth space being formed between any two adjacent casing sliding teeth.

20. The retractable cutting tool according to claim 16, further comprising:

a blade sheath snap ring;

an elastic snap collar, assembled into the blade sheath snap ring; and an elastic snap stopper, assembled into the blade sheath snap ring;

wherein the blade sheath snap ring comprises:

a snap ring body, protruding from a surface of the blade sheath;

a snap ring base, arranged at a top of the snap ring body;

a snap ring stop piece, protruding from the snap ring base;

a sliding tooth opening, penetrating through a sidewall of the snap ring body; and a snap stopper mounting pillar, protruding from the surface of the blade sheath and arranged in a center of the blade sheath snap ring;

wherein the elastic snap collar comprises:

a snap collar sliding tooth, protruding from an outer sidewall of the elastic snap collar and passing through the sliding tooth opening to be snap-fitted to any one of casing sliding tooth spaces; and a snap collar opening, arranged at a sidewall of the elastic snap collar which is disconnected at the snap collar opening;

wherein the elastic snap stopper comprises a snap stopper base, arranged in a casing hollow cavity; and a snap stopper sleeve, protruding from the snap stopper base, provided around outside of the snap stopper mounting pillar.

* * * * *